US008766863B2

(12) United States Patent
Yun

(10) Patent No.: US 8,766,863 B2
(45) Date of Patent: Jul. 1, 2014

(54) ANTENNA SIMPLY MANUFACTURED ACCORDING TO FREQUENCY CHARACTERISTIC

(75) Inventor: So-Hyeun Yun, Daejeon-si (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 422 days.

(21) Appl. No.: 13/287,182

(22) Filed: Nov. 2, 2011

(65) Prior Publication Data

US 2012/0112977 A1 May 10, 2012

(30) Foreign Application Priority Data

Nov. 9, 2010 (KR) ..... 10-2010-0111012

(51) Int. Cl.
*H01Q 13/10* (2006.01)

(52) U.S. Cl.
USPC ..... 343/772; 343/848

(58) Field of Classification Search
USPC ..... 343/772, 786, 848
See application file for complete search history.

(56) References Cited

U.S. PATENT DOCUMENTS

| | | | | |
|---|---|---|---|---|
| 3,740,754 | A * | 6/1973 | Epis | 343/797 |
| 5,568,157 | A * | 10/1996 | Anderson | 343/713 |
| 5,874,924 | A * | 2/1999 | Csongor et al. | 343/797 |
| 6,756,942 | B2 * | 6/2004 | Heyde | 343/700 MS |

FOREIGN PATENT DOCUMENTS

| | | |
|---|---|---|
| EP | 1 443 593 A1 | 8/2004 |
| KR | 2003-0055418 | 7/2003 |
| KR | 10-2004-0070024 | 8/2004 |
| WO | WO-96/18219 A1 | 6/1996 |

* cited by examiner

*Primary Examiner* — Tan Ho
(74) *Attorney, Agent, or Firm* — Rabin & Berdo, P.C.

(57) ABSTRACT

Provided is an antenna simply manufactured according to a frequency characteristic. The disk-shaped antenna having a screw tap structure includes a center post having a screw tap, a ground plane, and a disk radiator, so that a distance between a ground plane and a disk radiator can be finely tuned, and manufacturing and assembly error can be reduced to minimize differences in electrical characteristics between devices.

9 Claims, 4 Drawing Sheets

ANTENNA SIMPLY MANUFACTURED ACCORDING TO FREQUENCY CHARACTERISTIC

CROSS REFERENCE TO RELATED APPLICATIONS

This application claims priority from Korean Patent Application No. 10-2010-0111012, filed on Nov. 9, 2010, the disclosure of which is incorporated herein in its entirety by reference.

BACKGROUND OF THE INVENTION

1. Field of the Invention

The present invention relates to a disk-shaped antenna frequently used in systems requiring many phased-array devices to form multiple beams, and more particularly, to an antenna which allows a resonant frequency of the antenna to be selected according to the size of a disk and feed position and thus, can be simply used according to a frequency characteristic.

2. Description of the Related Art

To provide mobile communication service, the demand for an antenna having a wideband or multi-band frequency characteristic with regards to frequency, and capable of forming multiple beams with regards to service is increasing.

To meet this demand, development of a reflector antenna employing a phased-array device as a feeder is ongoing. Each individual device used as a phased-array device should have electrically excellent characteristics.

To this end, a radiator is manufactured in a disk form, and an antenna is configured to have a support structure for the disk radiator. The disk support structure has the form of a pipe having a thin wall structure formed of a dielectric having a low loss tangent (tan δ), and thus, is lightweight.

Also, to simplify manufacturing, the disk support structure is separately manufactured according to the size and position of the disk radiator. In conventional art, the disk support structure is referred to as an upright (or pipe) socket.

An antenna consists of at least one disk radiator and at least two sockets. A first socket is disposed at the center of and above a ground plane, a disk radiator is disposed above the first socket, and a second socket is disposed above the disk radiator. The respective sockets may have the same or different diameters, and all the components are assembled using an adhesive.

To manufacture a large number of individual devices, such a method requires a lot of manual work, and may have problems of durability according to characteristics of the adhesive. Individual devices to be used in a system including many phased-array devices should be simply manufactured to have minimal error and the same characteristics despite manufacturing the devices several times.

To this end, manual work should be avoided as much as possible. To solve this problem, a disk-shaped antenna needs to be manufactured only by assembly without an adhesive. This increases the probability that many manufactured feeding devices will have the same characteristics. Also, when a frequency varies or a wideband or multi-band frequency is required, a disk-shaped antenna can be easily completed by manufacturing only a disk radiator according to a frequency band.

SUMMARY OF THE INVENTION

Since it is possible to reduce manufacturing error of feeding devices produced in large quantities, and omit manual work such as an adhesion process, errors resulting from assembly can also be reduced.

Also, a disk-shaped antenna can be simply manufactured even when a required frequency characteristic varies.

According to an exemplary aspect, there is provided an antenna simply manufactured according to a frequency characteristic The antenna includes a ground plane, a radiator and a resonant cup. The ground plane has a circular shape having a combination groove. The radiator is combined with the combination groove of the ground plane and disposed above the ground plane. The resonant cup is combined with an outer side surface of the ground plane to surround the radiator.

A combination groove having a screw groove accommodating a screw tap is formed at a center of the ground plane.

The screw tap is formed under the radiator and combined with the combination groove of the ground plane, and the radiator is disposed above and apart from the ground plane.

The radiator has a number equal to or greater than one, has different sizes, and is disposed above and apart from the ground plane to adjust operating frequency.

The resonant cup is formed to be combined along the outer side surface of the ground plane according to a direction in which a signal is directed.

The resonant cup surrounds the radiator to bury the radiator in the resonant cup itself and reduce reflection loss of a signal.

The resonant cup is formed to have a height adjusted in a vertical direction of the ground plane.

The disk-shaped antenna having the ground plane, the radiator, and the resonant cup is plural in number and disposed to have a wideband or multi-band operating frequency, and forms multiple beams.

Exemplary embodiments of the present invention provide a reference graph from which the size of a disk radiator can be selected according to a required operating frequency.

Exemplary embodiments of the present invention also provide a center post having a screw tap, a ground plane, and a disk radiator to reduce manufacturing and assembly error and minimize differences in electrical characteristics between devices.

Further, the distance between a ground plane and a disk radiator can be finely tuned in a disk-shaped antenna having a screw tap structure.

It is to be understood that both the foregoing general description and the following detailed description are exemplary and explanatory, and are intended to provide further explanation of the invention as claimed.

BRIEF DESCRIPTION OF THE DRAWINGS

The accompanying drawings which are included to provide a further understanding of the invention and are incorporated in and constitute a part of this specification, illustrate exemplary embodiments of the invention, and together with the description serve to explain the aspects of the invention.

DETAILED DESCRIPTION OF EMBODIMENTS

The detailed description is provided to assist the reader in gaining a comprehensive understanding of the methods, apparatuses and/or systems described herein. Various changes, modifications, and equivalents of the systems, apparatuses, and/or methods described herein will likely suggest themselves to those of ordinary skill in the art. Also, descriptions of well-known functions and constructions are omitted to increase clarity and conciseness.

Figure 1:
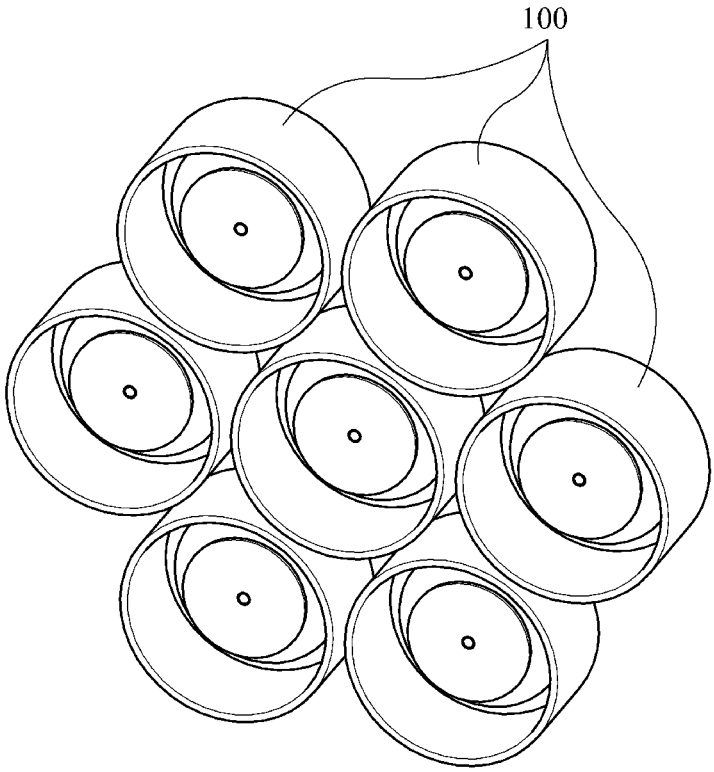
FIG. 1 shows a disk-shaped antenna forming multiple beams for mobile communication service according to an exemplary embodiment of the present invention.

FIG. 1 shows a disk-shaped antenna 100 forming multiple beams for mobile communication service according to an exemplary embodiment of the present invention.

The disk-shaped antenna 100 of FIG. 1 forming multiple beams is merely an example consisting of seven individual antenna devices, and the number of devices may vary according to system requirements.

Needless to say, manufacturing needs to be precisely performed so that feeding devices having the same structure as shown in FIG. 1 can be uniformly used.

Figure 2:
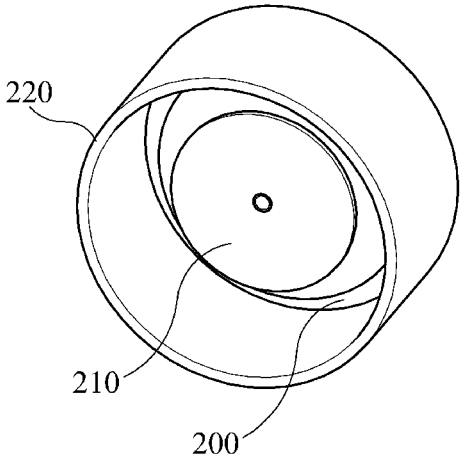
FIG. 2 shows a disk-shaped antenna used as a phased-array device for mobile communication service according to an exemplary embodiment of the present invention.
Figure 3:
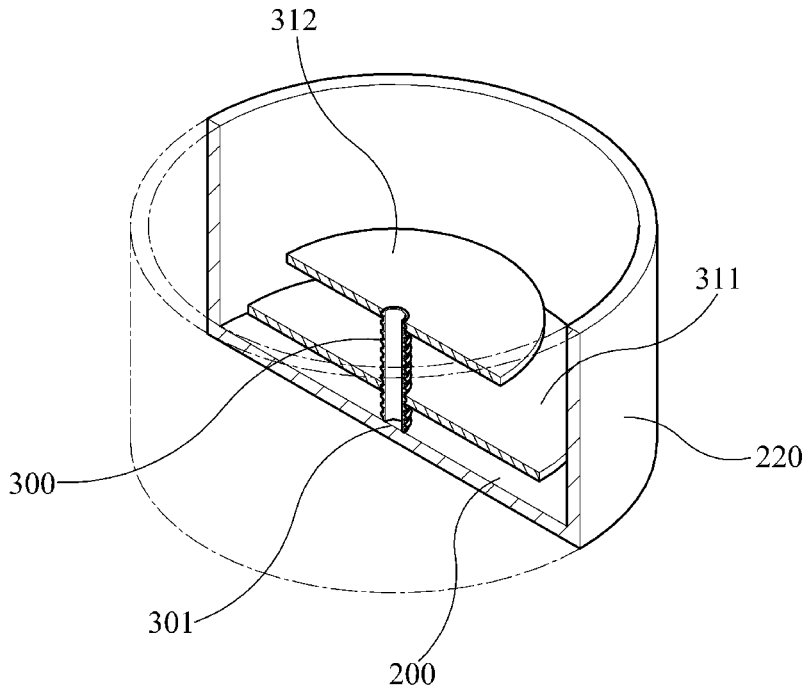
FIG. 3 is a cross-sectional view showing a detailed structure of a disk-shaped antenna for mobile communication service according to an exemplary embodiment of the present invention.

To this end, the present invention proposes disk-shaped antenna structures as shown in FIGS. 2 and 3.

FIG. 2 shows a disk-shaped antenna used as a phased-array device for mobile communication service according to an exemplary embodiment of the present invention. Referring to FIG. 2, a disk-shaped antenna may include a ground plane 200, a radiator 210, and a resonant cup 220.

The ground plane 200 has a circular shape having a combination groove.

The radiator 210 is combined with the combination groove of the ground plane 200 and disposed above the ground plane 200.

The resonant cup 220 is combined with an outer side surface of the ground plane 200 to surround the radiator 210.

A plurality of the disk-shaped antennas including the ground plane 200, the radiator 210, and the resonant cup 220 may be disposed to have a wideband or multi-band operating frequency, and to form multiple beams.

A structure which can be easily combined and manufactured on the basis of the basic structure of the disk-shaped antenna of FIG. 2 is shown in FIG. 3.

FIG. 3 is a cross-sectional view showing a detailed structure of a disk-shaped antenna for mobile communication service according to an exemplary embodiment of the present invention.

At the center of a ground plane 200, a combination groove 301 which is a screw groove accommodating a screw tap, is formed. A screw tap 300 is formed under radiators 311 and 312, and combined with the combination groove 301 of the ground plane 200, and the radiators 311 and 312 are disposed above and apart from the ground plane 200.

The ground plane 200 and the radiators 311 and 312 of the disk-shaped antenna are supported by the combination groove 301. To simplify and reduce manufacturing/assembly error, the screw tap 300 is engaged with the outside of the combination groove 301 and the insides of center holes of the radiators 311 and 312.

The radiators 311 and 312 having different sizes may be disposed above and apart from the ground plane 200, thereby adjusting operating frequency.

Since the number of radiators is selected according to operating frequency, the two radiators 311 and 312 are shown as an example in FIG. 3. Distances from the ground plane 200 to the radiators 311 and 312 having the screw tap 300 can be adjusted, and thus fine tuning is enabled.

The resonant cup 220 is combined along the outer side surface of the ground plane 200 and formed according to a direction in which a signal is directed. Also, the resonant cup 220 surrounds the radiators 311 and 312 to bury the radiators 311 and 312 therein, thereby reducing reflection loss of a signal.

The resonant cup 220 is formed with a height thereof adjusted in the vertical direction of the ground plane 200.

The resonant cup 220 formed around the radiators 311 and 312, increases directivity of the antenna and enhances a reflection loss characteristic. Also, characteristics of the antenna vary according to the height of the resonant cup 220, so that a tuning effect can be obtained according to the height.

As mentioned above, a frequency characteristic of a disk-shaped antenna is dependent on the size of a radiator.

Figure 4:
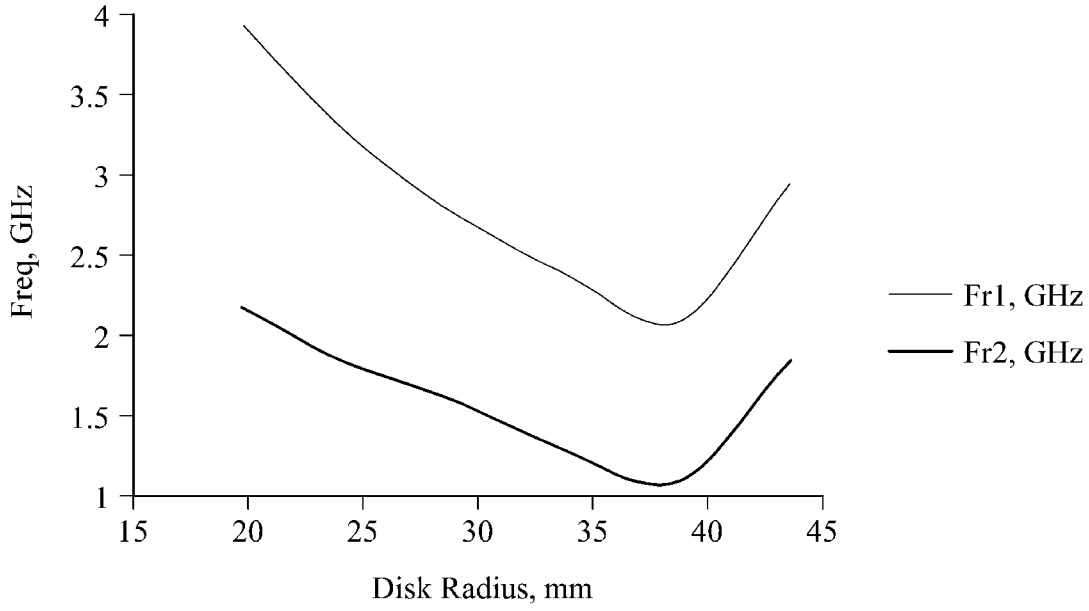
FIG. 4 is a graph showing a frequency characteristic of a disk-shaped antenna according to an exemplary embodiment of the present invention with respect to radiator size.

A frequency characteristic of an antenna with respect to radiator size is shown in FIG. 4.

FIG. 4 is a graph showing a frequency characteristic of a disk-shaped antenna according to an exemplary embodiment of the present invention with respect to radiator size.

A first frequency Fr1 is a frequency at which a first resonance occurs, and a second frequency Fr2 is a frequency at which a second resonance occurs.

Due to periodicity of a wavelength, the first frequency Fr1 is a multiple of the second frequency Fr2, or vice versa. When the frequencies and disk size are compared with a wavelength, the disk size is generally equal to $0.15\lambda_1$ and $0.28\lambda_2$ (where, $\lambda_1$ is a first resonant wavelength, and $\lambda_2$ is a second resonant wavelength).

The size and number of disks may be determined by such a relationship to a resonant frequency. In other words, two radiators may be used for a double frequency characteristic, and three radiators may be used for a triple frequency characteristic.

Thus, a radiator having an appropriate size is selected from a graph, as shown in FIG. 4, according to a required operating frequency, and manufactured to have a screw tap, so that design time and manufacturing/assembly error can be reduced.

It will be apparent to those of ordinary skill in the art that various modifications can be made to the exemplary embodiments of the invention described above. However, as long as modifications fall within the scope of the appended claims and their equivalents, they should not be misconstrued as a departure from the scope of the invention itself.

What is claimed is:

1. An antenna simply manufactured according to a frequency characteristic, comprising:

a ground plane having a circular shape having a combination groove;

a radiator combined with the combination groove of the ground plane and disposed above the ground plane; and a resonant cup combined with an outer side surface of the ground plane to surround the radiator.

2. The antenna of claim 1, wherein a combination groove having a screw groove accommodating a screw tap is formed at a center of the ground plane.

3. The antenna of claim 2, wherein the screw tap is formed under the radiator and combined with the combination groove of the ground plane, and the radiator is disposed above and apart from the ground plane.

4. The antenna of claim 1, wherein the radiator has a number equal to or greater than one, and is disposed above and apart from the ground plane to adjust operating frequency.

5. The antenna of claim 1, wherein the radiator has a number equal to or greater than one, has different sizes, and is disposed above and apart from the ground plane to adjust operating frequency.

6. The antenna of claim 1, wherein the resonant cup is formed to be combined along the outer side surface of the ground plane according to a direction in which a signal is directed.

7. The antenna of claim 1, wherein the resonant cup surrounds the radiator to bury the radiator in the resonant cup itself and reduce reflection loss of a signal.

8. The antenna of claim 1, wherein the resonant cup is formed to have a height adjusted in a vertical direction of the ground plane.

9. The antenna of claim 1, wherein the disk-shaped antenna having the ground plane, the radiator, and the resonant cup is plural in number and disposed to have a wideband or multiband operating frequency, and forms multiple beams.

* * * * *